US005743044A

United States Patent [19]

Hopkins

[11] Patent Number: 5,743,044

[45] Date of Patent: Apr. 28, 1998

[54] FLOWER POT SUPPORT BRACKET

[76] Inventor: Jack A. Hopkins, P.O. Box T, Omak, Wash. 98841

[21] Appl. No.: 668,722

[22] Filed: Jun. 24, 1996

[51] Int. Cl.[6] ..... A41G 7/02

[52] U.S. Cl. ..... 47/67

[58] Field of Search ..... 47/67; 403/270

[56] References Cited

U.S. PATENT DOCUMENTS

| | | | |
|---|---|---|---|
| 52,200 | 1/1866 | Prince . | |
| 1,538,081 | 5/1925 | Bank | 47/67 |
| 3,631,585 | 1/1972 | Stamm | 403/270 |
| 4,102,081 | 7/1978 | Morrow | 47/67.83 |
| 4,227,343 | 10/1980 | Espy et al. | 47/47 |
| 4,635,394 | 1/1987 | Brown | 47/67.39 |
| 5,052,148 | 10/1991 | Shanon | 47/248 |
| 5,393,164 | 2/1995 | Renner | 403/270 |

FOREIGN PATENT DOCUMENTS

| | | | |
|---|---|---|---|
| 1267541 | 3/1972 | United Kingdom | 47/67 |

*Primary Examiner*—John A. Ricci
*Attorney, Agent, or Firm*—David S. Thompson

[57] ABSTRACT

A flower pot support bracket, adapted for use in hanging a flower pot, is disclosed. The flower pot support bracket provides a central supporting rod having an upper hook that is carried by an elevated supporting structure. The rod extends through the potting soil, and out a centrally located drain hole in the bottom of the pot. Attached to the lower end of the rod is a support plate, which supports the bottom of the flower pot. Several versions of the support bracket are disclosed. In a first version of the invention, the supporting rod passes through a center hole in the support plate, and the two are welded together. In a second version of the invention, the center hole of the support plate and the end portion of the rod are threadedly connected. In a third version of the invention, an inch or so of the lower portion of the rod is bent at 90 degrees. The support plate provides an upwardly directed dimple adjacent to the center hole that partially encloses the bent end of the rod. In this version of the invention, the weight of the pot is supported by the plate, which is supported by the bent end. In a fourth version of the invention, which is similar to the third version, the circular support plate provides an off-center hole and dimple, thereby causing the support plate to balance on the bent end prior to installation of the flower pot.

3 Claims, 4 Drawing Sheets

5743044

FLOWER POT SUPPORT BRACKET

CROSS-REFERENCES

There are no applications related to this application filed in this or any foreign country.

BACKGROUND

Hanging flower and plant pots is a popular means to increase the beauty of any area, and also a means to position plants more advantageously with respect to light and air. Of the flower pots that are commonly used, wood pots are among the most attractive and are frequently hung by means of ropes or wires that are attached to the pot in three or four locations about its upper rim. While not particularly aesthetic, such an attachment method does adequately support the plant. Foliage hanging downwardly is typically somewhat restricted by the wires, in that the foliage must be divided among the spaces between the wires, thereby giving it a somewhat segmented and unnatural appearance.

Unfortunately, the common red clay flower pots that are very popular among gardeners do not allow the attachment of wires or ropes about the rim of the pot, because drilling the necessary holes causes the material from which the pot is made to fracture, crack and crumble. To hang flower pots of this type, it is necessary to have ropes passing underneath the pot. Various rope and macrame solutions have been developed in this area. Unfortunately, most of these devices are difficult to use, present the same disadvantages as the wire used to hang wood pots, with additional problems related to keeping the entire pot from falling out of the hanger, in the event that two rope or macrame elements become too widely spaced.

For the foregoing reasons, there is a need for a flower pot support bracket that can be used to support wood, clay and other types of pots in a secure manner that does not require the foliage to be divided and bunched between supporting wires, ropes or macrame. The flower pot support bracket must be able to support substantial weight, and yet must not be overly bulky. The bracket must also be adaptable to wood, clay and other types of commonly used pots. The bracket must be inexpensive to manufacture, easy to assemble and attractive in any decor.

SUMMARY

The present invention is directed to an apparatus that satisfies the above needs. A novel flower pot support bracket, for use in hanging a flower pot, is provided that solves the above problems and satisfies the above requirements.

The flower pot support bracket, suitable for hanging most of the flower pots commercially sold, of the present invention provides:

(a) A support rod provides an upper hook or an upper support hole, an elongate body that is oriented during use in the vertical direction, and a lower end having means to fasten to a support plate. The upper hook, or upper support hole, of the support rod is suitable for attachment to a supporting hook or nail. The elongate body of the support rod extends from the upper hook, downwardly through the potting soil carried by the flower pot. The lower end of the support rod extends through the drain hole in the center of the bottom of the flower pot.

(b) A support plate, carried by the lower end of the support rod, supports the bottom surface of the flower pot. In a first version of the invention, the support plate is a round piece of steel having a central hole sized to allow the support rod to pass through. The flower pot support bracket is assembled by welding the support rod to the support plate. In a second version of the invention, the center hole of the support plate provides internal threads, and the lower end of the support rod provides matched external threads. In a third version of the invention, the lower end of the support rod is bent at 90 degrees to the body of the rod. A dimple in the support plate adjacent to the center hole is sized to accommodate the lower bent end of the support rod. In this version of the invention, the weight of the flower pot is carried by the support plate, which in turn rests on the bent end of the support rod. A fourth version of the flower pot support bracket of the invention is similar to the third version, except that the support plate provides an off-center hole or a non-round shape. As a result, when the support plate is positioned on the bent end of the support rod, prior to positioning the flower pot on the support plate, the support plate tends to balance in the horizontal plane.

It is therefore a primary advantage of the present invention to provide a novel flower pot support bracket that may be used to support most commercially available flower pots without the use of chains, wires, ropes, macrame or cords.

Another advantage of the present invention is to provide a novel flower pot support bracket that is extremely durable, and will support flower pots of large mass.

Another advantage of the present invention is to provide a novel flower pot support bracket that is easily and economically manufactured and shipped.

Another advantage of the present invention is to provide a novel flower pot support bracket that is attractive and suitable for any decor.

A still further advantage of the present invention is to provide a novel flower pot support bracket that is easier and more convenient to use than prior flower pot support devices, and that solves the problems common to those brackets.

DRAWINGS

These and other features, aspects, and advantages of the present invention will become better understood with regard to the following description, appended claims, and accompanying drawings where:

DESCRIPTION

Throughout the application the term flower pot is used to mean any type of container, pot, planter or other vessel that is used to carry live plants. Such containers are typically cylindrical, although elongate rectangular and other types of planters may also be included within the term.

Figure 1:
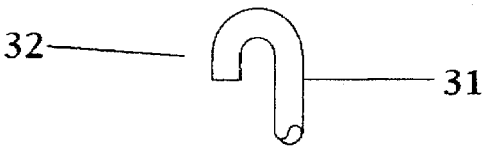
FIG. 1 is a side orthographic view of a version of the invention having the support rod connected to the support plate by threaded fastening means.
Figure 2:
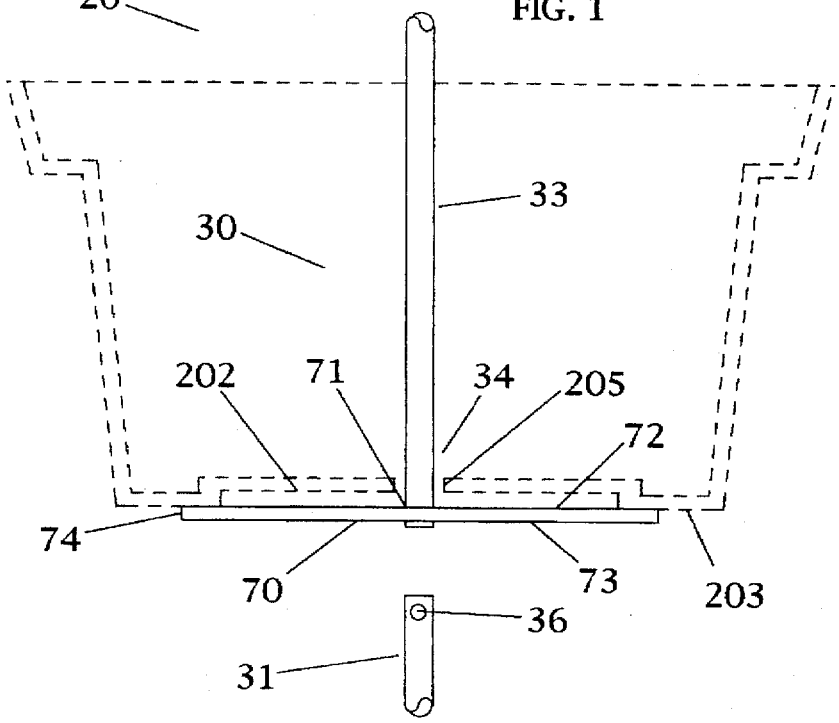
FIG. 2 is a side orthographic view of a version of the invention providing a support rod having a lower bent end supporting the support plate.
Figure 15:
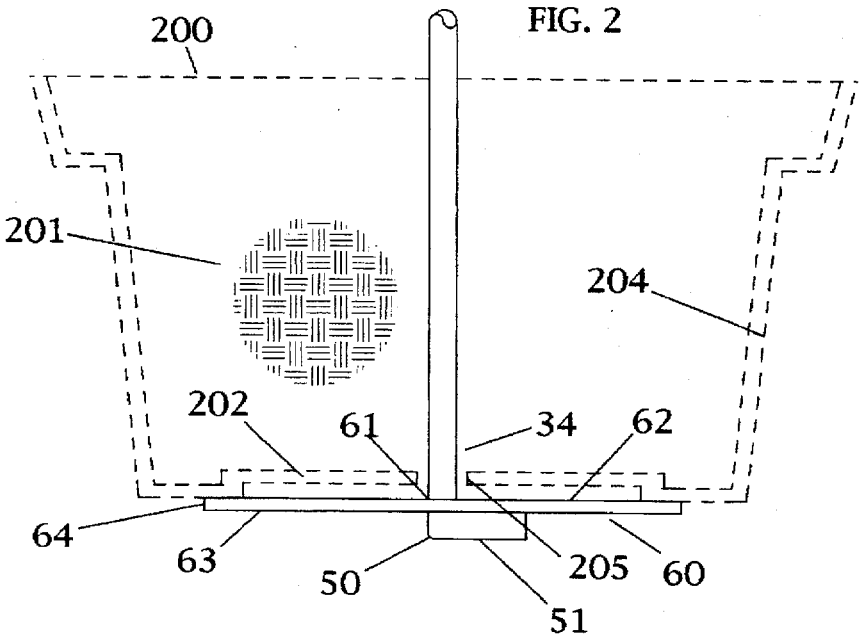
FIG. 15 is a side orthographic view of the flower pot support bracket of FIG. 1.
Figure 15:
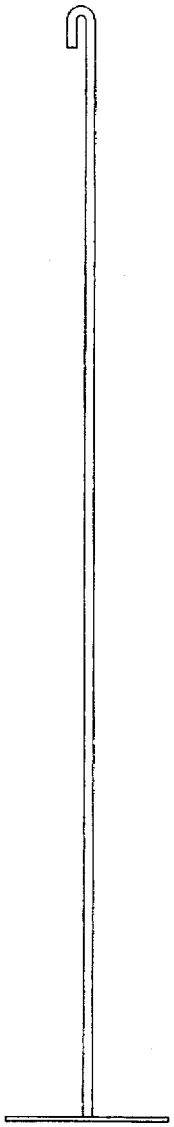

Referring in particular to FIGS. 1 and 2, a flower pot support bracket constructed in accordance with the principles of the invention is seen. The flower pot support bracket 20 provides a central supporting rod 30 having an upper hook 32 or upper support hole 36 that in use is attached to an elevated supporting structure. The rod extends through the potting soil, and out a centrally located drain hole in the bottom of the flower pot 200. Attached to the lower end of the rod is a support plate, which supports the bottom of the flower pot. Several versions of the support bracket are disclosed. In a first version of the invention, the supporting rod passes through a support plate 60 having a center hole, and the two are welded together. In a second version of the invention, the center hole of a support plate 70 and the lower end portion of the rod are threadedly connected. In a third version of the invention, an inch or so of the lower portion of the support rod is bent at 90 degrees. A support plate 80 provides an upwardly directed dimple adjacent to the center hole that partially encloses the bent end of the rod. In this version of the invention, the weight of the pot is supported by the plate, which is supported by the bent end. A fourth version of the invention is similar to the third version, however a support plate 90 may be non-round in construction, and provides an off-center hole and dimple, thereby allowing the center of gravity of the support plate to balance on the bent end of the support rod prior to installation of the flower pot 200.

Referring to FIGS. 1 and 2, the support rod 30 of the invention is seen. In the preferred embodiment the support rod is made steel, although aluminum rod may be used due to its advantageous resistance to corrosion. The rod typically will have a cross-section with a diameter of ¼" or less. The length of the body 33 of the rod may be varied considerably, although a length between 3 feet and 4 feet is typical. The length of the support rod is governed by the application. For example, where the plant is to be supported from a ceiling, the chosen length may be longer if the ceiling is higher. In most applications, the rod is covered by a paint or other coating that retards corrosion, such as enamel.

The support rod provides an upper portion 31 carrying an upper hook 32. The hook may be sized so that it is insertable into the drain hole 205 of the flower pot 200, and so that it may be attached to a nail, eyelet or small hook carried by a supporting structure.

As seen in FIG. 2, an upper support hole 36 optionally may replace upper hook 32. The hole 36 is advantageous over the upper hook 32, in that it fits through a drain hole 205 more easily, and where an already-potted plant is to be supported, hole 36 may be rammed upwardly through potting soil more easily. However, in most cases it is more costly to construct hole 36 than hook 32, and hole 36 is unable to attach to some supporting hooks.

Figure 7:
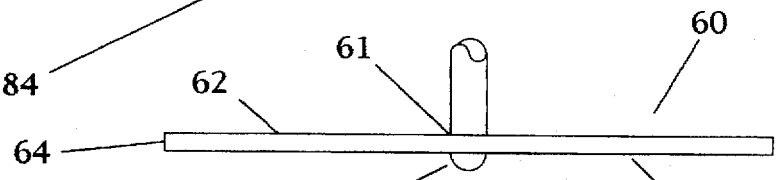
FIG. 7 is a side orthographic view of a version of the invention having the lower end of the support rod welded to the bottom of the support plate.

The support rod 30 provides a lower portion 34 having fastening means for attaching the support rod to the support plate. As seen in FIG. 7, the support rod may be connected to the support plate by a welded connection 35.

Figure 8:
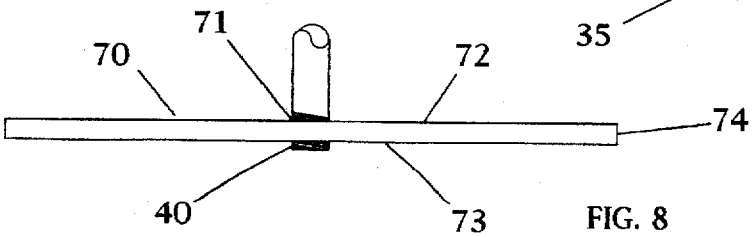
FIG. 8 is a side orthographic view of a version of the invention having the lower end of the support rod threadedly attached to the bottom of the support plate.
Figure 9:
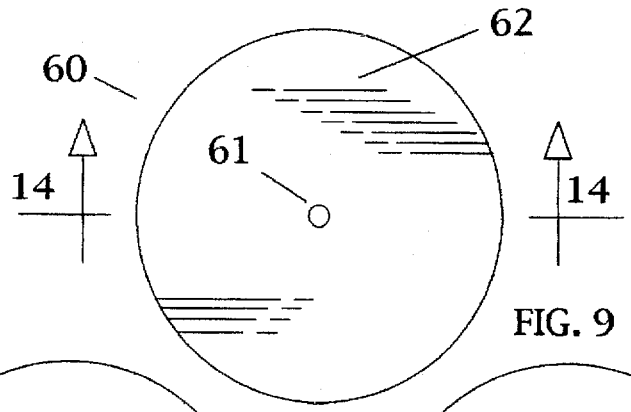
FIG. 9 is a top orthographic view of a support plate having a center hole.

Alternatively, as seen in FIG. 8, a version of the support rod of the invention may be connected to the support plate by a threaded connection. Threads 40 on the lower portion of the support rod engage a threaded hole 71 in a threaded version of the support plate 70.

A still further alternative support rod structure may be used to attach the support rod to the support plate. As seen in FIGS. 2–6, a bend 50 in the lower portion 34 of a support rod produces a bent end 51 that may be used to uphold the support plate 60, 80, 90. The bent end is typically 1 to 1.5 inches in length, although a greater or lesser length could be employed.

As seen in FIG. 7, one version of the support plate 60 having a center hole 61 may be attached to the lower portion 34 of the support rod by a welded connection 35. The support plate of this version of the invention provides upper and lower surfaces 62, 63 and a perimeter rim 64. The perimeter rim is typically 6 inches or more in length, although the exact dimensions are not critical in most applications.

As seen in FIG. 8, a second version of the support plate 70 having a threaded center hole 71 may be attached to the lower portion 35 of the support rod by threads 40. The support plate of this version of the invention also provides upper and lower surfaces 72, 73 and a perimeter rim 74, typically 6 or more inches in length.

Figure 3:
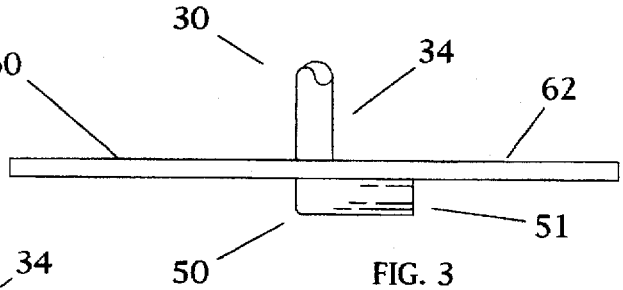
FIG. 3 is a side orthographic view showing the details of the lower bent end of the support rod supporting the support plate.
Figure 4:
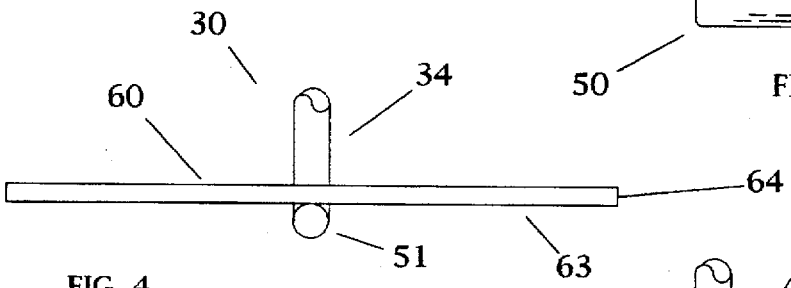
FIG. 4 is a side orthographic view of the invention of FIG. 3, rotated 90 degrees.

As seen in FIGS. 2–4, the support plate 60 described above may also be attached to a support rod 30 having a bend 50 forming a lower bent end 51. As seen in FIG. 3, the bent end 51 may be inserted into hole 61. The support rod 30 may then be positioned so that the body 33 of the rod extends through the drain hole 205, as seen in FIG. 2, and so that the bottom surface 202 of the pot 200 is supported by the upper surface 62 of the support plate 60.

Figure 5:
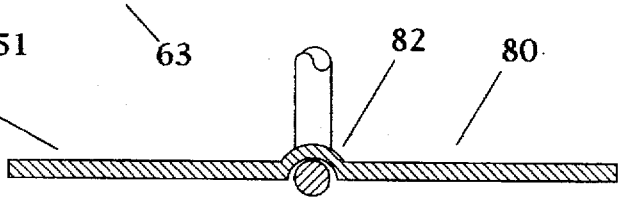
FIG. 5 is a side cross-sectional view of a version of the invention providing a support rod having a lower bent end supporting a support plate having a dimple.
Figure 6:
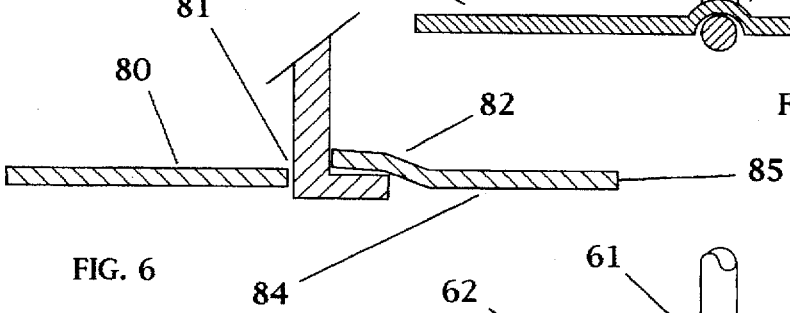
FIG. 6 is a cross-sectional view of the invention of FIG. 5 rotated 90 degrees.
Figure 10:
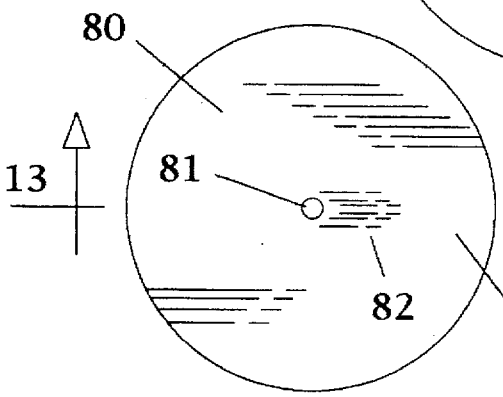
FIG. 10 is a top orthographic view of a support plate having a center hole and a dimple.

As seen in FIGS. 5, 6, and 10, a support plate 80 having a center hole 81 also provides a dimple 82 adjacent to the center hole. The support plate of this version of the invention also provides upper and lower surfaces 83, 84 and a perimeter rim 85. The dimple is typically formed by a stamping process using a die. As seen in FIGS. 5 and 6, the dimple is somewhat elongate; therefore it is sized to accommodate the bent end 51 of a support rod.

Figure 12:
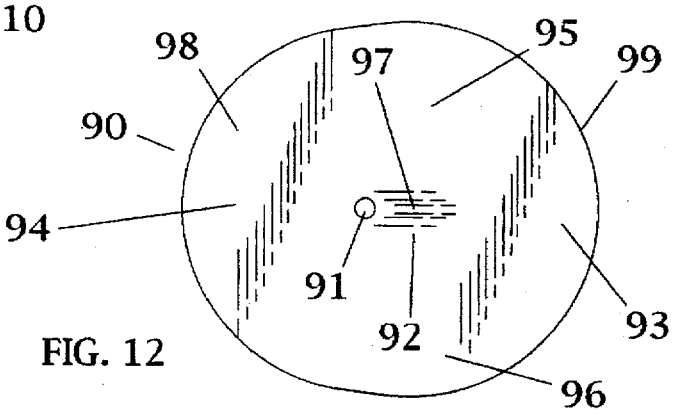
FIG. 12 is a top orthographic view of a support plate having a non-round construction and an off-center hole with a dimple.
Figure 13:
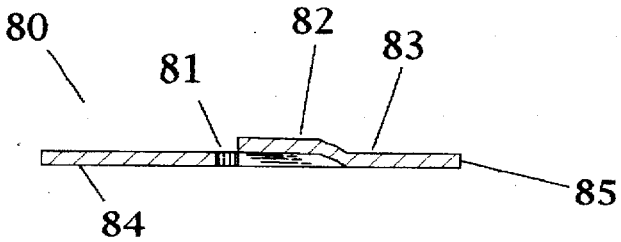
FIG. 13 is a cross-sectional view of the support plate of FIG. 10.
Figure 14:
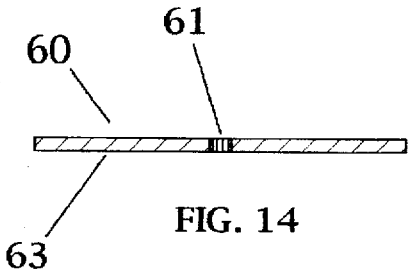
FIG. 14 is a cross-sectional view of the support plate of FIG. 9.

As seen in FIGS. 12 and 13, a non-round support plate 90 provides an off-center hole 91 having an adjacent dimple 92. The support plate of this version of the invention also provides upper surface 98, a lower surface and a perimeter rim 99. The support plate 90 is carried by the lower bent end 51 of a support rod, in the manner seen in FIGS. 5 and 6. Referring to FIG. 12, there is a heavy side 93 and a light side 94, as well as left side 95 and a right side 96. As seen in FIG. 12, the heavy side is adjacent to the dimple, which carries the bent end. The light side is opposite the heavy side and the bent end. The dimple 92 is along the axis of symmetry, dividing the left and right sides, and is sized to support the bent end 51 of the support rod. The center of gravity 97 is located in the area of the dimple 92, as seen in FIG. 12. As a result of the non-round, off-center hole construction, and the location of the center of gravity over the bent end 51, the non-round support plate 90 tends to balance on the support rod prior to installation of the flower pot.

Figure 11:
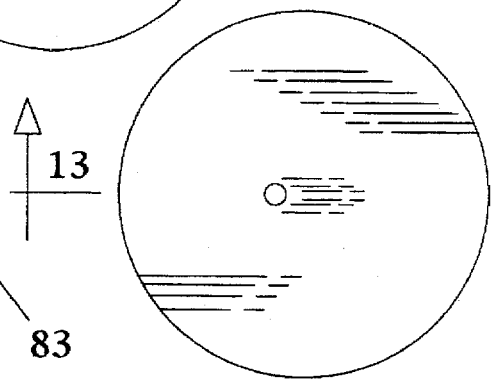
FIG. 11 is a top orthographic view of a support plate having an off-center hole and a dimple.

As seen in FIG. 11, a round support plate having a dimple is similar to the support plate of FIGS. 10 and 12.

Figure 16:
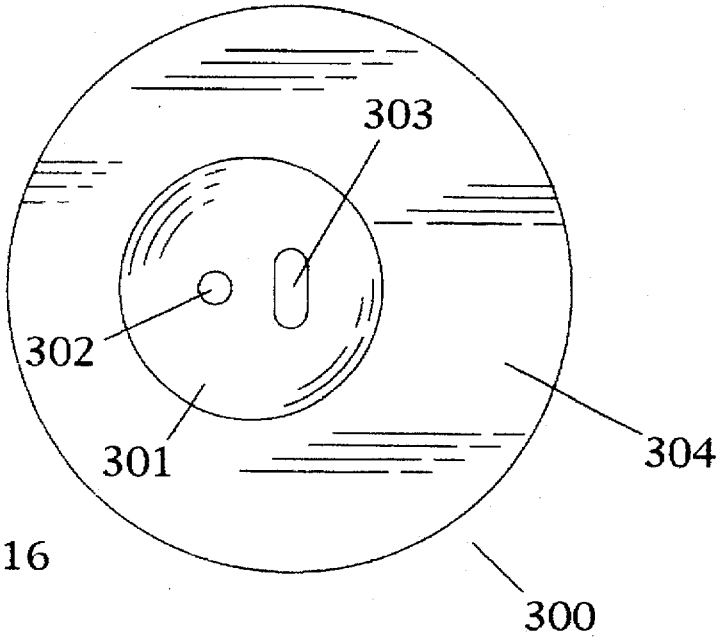
FIG. 16 is a top orthographic view of a support plate having a center slot and an off-center hole.
Figure 17:
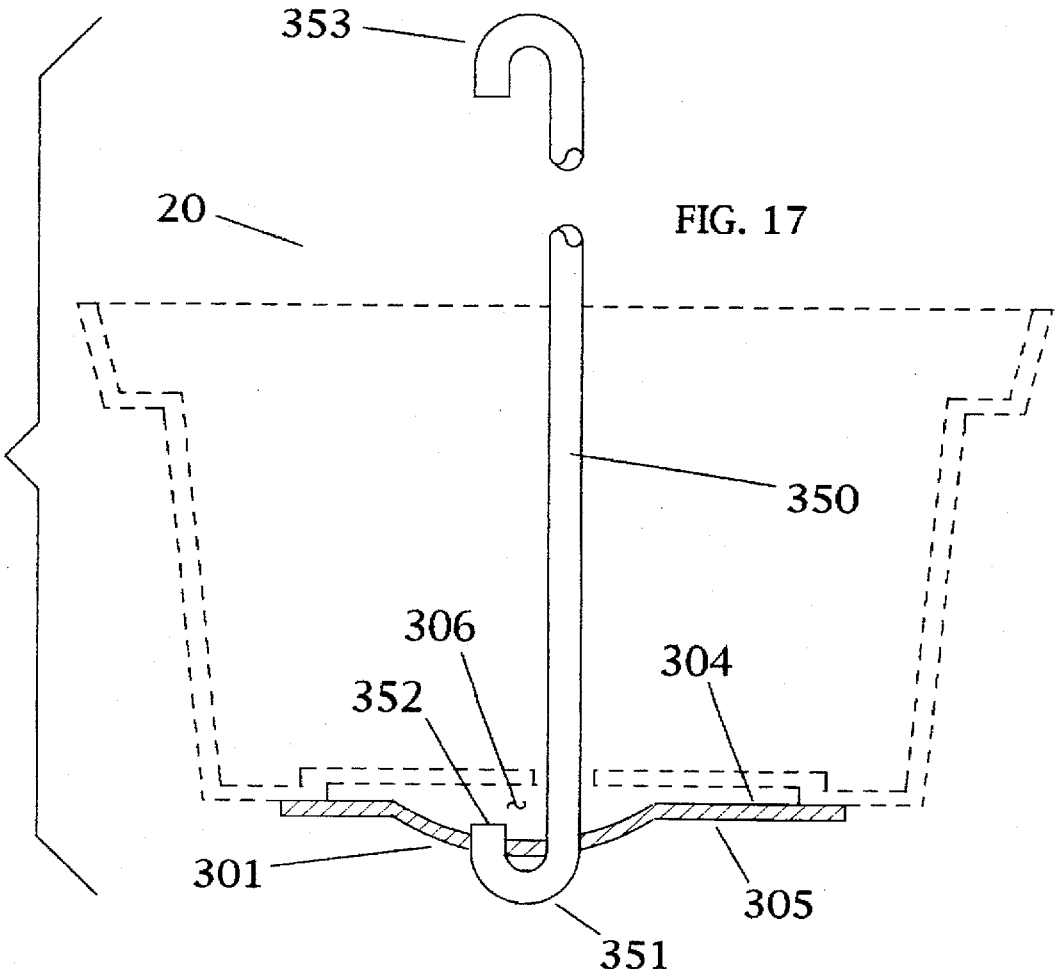
FIG. 17 is a side cross-sectional view of the support plate of FIG. 16 supported by a support rod having upper and lower hooks.

Referring to FIGS. 16 and 17, a further version of the invention is disclosed. A support plate 300 provides an upper surface 304 and a lower surface 305. A center slot 303 that is sized so that the lower hook 351 of a support rod 350 may be inserted. An off-center hole 302 is sized so that the end surface 352 of the lower hook 351 of the support rod 350 may be inserted.

Optionally, a dimple 301 forming a cavity 306 may be provided to allow some space between the lower end surface 352 of the support rod and the bottom of the flower pot. By carrying the lower end surface in the cavity formed by the dimple, the weight of the flower pot is carried by the support plate, and not by the lower end surface. In this manner, the weight of the flower pot rests on the upper surface 304 of the support plate. The support plate in turn is carried by the lower hook 351. The bracket is then attached to an external support surface by means of upper hook 353.

To use this version of the flower pot support bracket, the user first inserts the support rod through the drain hole of the flower pot. Depending on the diameter of the drain hole, this may require the use of upper support hole 36 in place of hook 353. The lower hook 351 is then inserted through the slot 303, and turned 90 degrees, so that the lower end surface 352 may be inserted through the hole 302, as seen in FIG. 17. A plant and potting soil may be placed in the pot, which is then supported by means of upper hook 353 or support hole 36.

To use the welded version of the invention, as seen particularly in FIG. 7, the user inserts the upper hook 32, or upper support hole 36, of the upper portion 31 of the support rod 30 into the drain hole 205 of a flower pot 200. Typically, this is done before potting soil is added. The support rod is moved until the upper surface 62 of the support plate 60 is adjacent to the bottom surface 202 of the flower pot. The potting soil 201 and plant are then added, around the support rod 30. The supporting bracket 20 is then hung on a supporting structure by means of hook 32 or hole 36.

To use the threaded version of the invention, the user has two options. The support plate 70 having a threaded hole 71 may be first attached to the threads 40 of the support rod. If this is done first, then the user proceeds as above. Alternatively, the user may insert the lower portion 34 of the support rod 30 into the cavity of the flower pot, and then out the drain hole 205. This may be done, with little effort, even in the event that the pot is full of potting soil and a plant. Typically, little damage is done to the plant, and the entire process is less trouble than repotting the plant after installing the support bracket 20. The support rod is then threadedly connected to the threaded hole 71 of the support plate 70. The potting soil and plant are then added, around the support rod 30. The supporting bracket 20 is then hung on a supporting structure by means of hook 32.

To use the version of the invention having a dimpled support plate 80, the user inserts the bent end 51 or the upper portion 31 of the support rod through the cavity of a flower pot formed by sidewalls 204, and through the drain hole 205. The bent end 51 is inserted through the center hole 81 of the support plate 80, positioning the bent end within the dimple 83, as seen in FIGS. 5 and 6. The support rod is moved until the upper surface 82 of the support plate 80 is adjacent to the bottom surface 202 of the flower pot, as seen in FIG. 2. Frequently, a bottom rim 203 of the flower pot will keep the dimple from contacting the bottom 202 of the flower pot, as seen in FIGS. 2 and 6. The potting soil and plant are then added, around the support rod 30. The supporting bracket 20 is then hung on a supporting structure by means of hook 32 or hole 36.

To use the version of the invention providing a dimpled support plate 90 having an off-center hole 91, the user follows the procedure above. However, due to the fact that the center of gravity 97 of the support is directly above the lower bent end 51 of the support rod, the non-round support plate 90 will balance on the bent end, thereby facilitating the user's efforts to install the flower pot.

All versions of the invention may be installed on a flower pot already having potting soil and a plant. The user first attaches the support rod and support plate. The user then places the support plate on the floor, and places one or both feet on top of the support plate, allowing the support rod to extend vertically. While carrying the flower pot in a vertical fashion, the user inserts the upper hook 32 or upper support hole 36 into the drain hole 205 and forces the rod through the potting soil until the bottom surface 202 is adjacent to the upper surface of the support plate.

The previously described versions of the present invention have many advantages, including a primary advantage of providing a novel flower pot support bracket that may be used to support most commercially available flower pots without the use of chains, wires, ropes, macrame or cords.

Another advantage of the present invention is to provide a novel flower pot support bracket that is extremely durable, and that will support a flower pot of large mass.

Another advantage of the present invention is to provide a novel flower pot support bracket that is easily and economically manufactured and shipped.

Another advantage of the present invention is to provide a novel flower pot support bracket that is attractive and suitable for any decor.

A still further advantage of the present invention is to provide a novel flower pot support bracket that is easier and more convenient to use than prior flower pot support devices, and that solves the problems common to those brackets.

Although the present invention has been described in considerable detail and with reference to certain preferred versions, other versions are possible. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A flower pot support bracket, suitable for supporting a flower pot, the flower pot support bracket comprising:

(A) a support rod, having an upper portion and a lower portion, comprising:

(a) upper fastening means, carried by the upper portion, for attaching the flower pot support bracket to a supporting structure; and (b) lower fastening means, carried by the lower portion, for fastening to a support plate, the lower fastening means comprising a welded connection between the lower portion of the support rod and the support plate; and (B) wherein the support plate, defines a hole sized incrementally greater than the diameter of the support rod, to allow passage of the support rod therethrough, the support plate additionally comprising:

(a) an upper surface, sized to support a bottom portion of the flower pot; and (b) a perimeter rim of at least 6 inches in length.

2. The flower pot support bracket of claim 1, in which the fastening means comprises:

(a) a bent end carried by the lower portion of the support rod; and (b) a dimple in the support plate, adjacent to the hole in the support plate, the dimple supported by the bent end of the support rod.

3. The flower pot support bracket of claim 1, in which the fastening means comprises:

(a) threads on the lower portion of the support rod; and (b) internal threads in the hole in the support plate, sized to engage the threads on the lower portion of the support rod.

* * * * *